US007513094B2

(12) United States Patent
Denney et al.

(10) Patent No.: US 7,513,094 B2
(45) Date of Patent: Apr. 7, 2009

(54) HORSE BITS

(76) Inventors: Susan Denney, Killane Nurseries, Ramsey, Isle of Man (GB) 1M7 5BB; Simon Willis, Killane Nurseries, Ramsey, Isle of Man (GB) 1M7 5BB ( * ) Notice: Subject to any disclaimer, the term of this patent is extended or adjusted under 35 U.S.C. 154(b) by 348 days.

(21) Appl. No.: 11/414,767

(22) Filed: Apr. 28, 2006

(65) Prior Publication Data

US 2006/0242932 A1 Nov. 2, 2006

(30) Foreign Application Priority Data

Apr. 29, 2005 (GB) ..... 0508733.3
Dec. 12, 2005 (GB) ..... 0525195.4

(51) Int. Cl.
*B68B 1/06* (2006.01)

(52) U.S. Cl. ..... 54/8

(58) Field of Classification Search ..... 54/7–9
See application file for complete search history.

(56) References Cited

U.S. PATENT DOCUMENTS

| | | | | | |
|---|---|---|---|---|---|
| 69,910 | A | * | 10/1867 | Gates | 54/7 |
| 290,859 | A | * | 12/1883 | Chandler | 54/7 |
| 356,942 | A | | 2/1887 | Johnston | |
| 453,846 | A | | 6/1891 | McNair | |
| 526,241 | A | | 9/1894 | Lesser | |
| 570,312 | A | | 10/1896 | Kiehl | |
| 574,058 | A | | 12/1896 | Bates | |
| 720,689 | A | * | 2/1903 | Hall et al. | 54/7 |
| 904,682 | A | * | 11/1908 | Ciammaichella | 54/9 |
| 907,816 | A | | 12/1908 | Klaus | |
| 993,608 | A | * | 5/1911 | Martin | 54/9 |
| 1,116,159 | A | * | 11/1914 | Swart | 54/7 |
| 2,512,244 | A | * | 6/1950 | De Wolfe | 54/6.1 |
| 2,810,250 | A | * | 10/1957 | Smith | 54/7 |

FOREIGN PATENT DOCUMENTS

GB 144917 6/1920

OTHER PUBLICATIONS

European Search Report, Jul. 14, 2006.

* cited by examiner

*Primary Examiner*—Son T. Nguyen
(74) *Attorney, Agent, or Firm*—Young Basile

(57) ABSTRACT

The present invention provides a horse bit 1 comprising a pair of side cheeks 2,3 each having a cheek strap coupling portion 4 and a first cheek portion 5 mounting a respective end of a mouth-piece 7. A second cheek portion 8 is connected to the first 5 so as to be displaceable between first and second positions, and has a rein coupling portion 10. A resilient biasing means 24 acts between the first and second cheek portions 5,8 so as to resist displacement of the second cheek portion 8 relative to the first 5, when a user pulls on the reins 11, whereby transmission of force through the reins 11 to the mouth-piece 7 is modulated.

2 Claims, 6 Drawing Sheets

FIG. 4
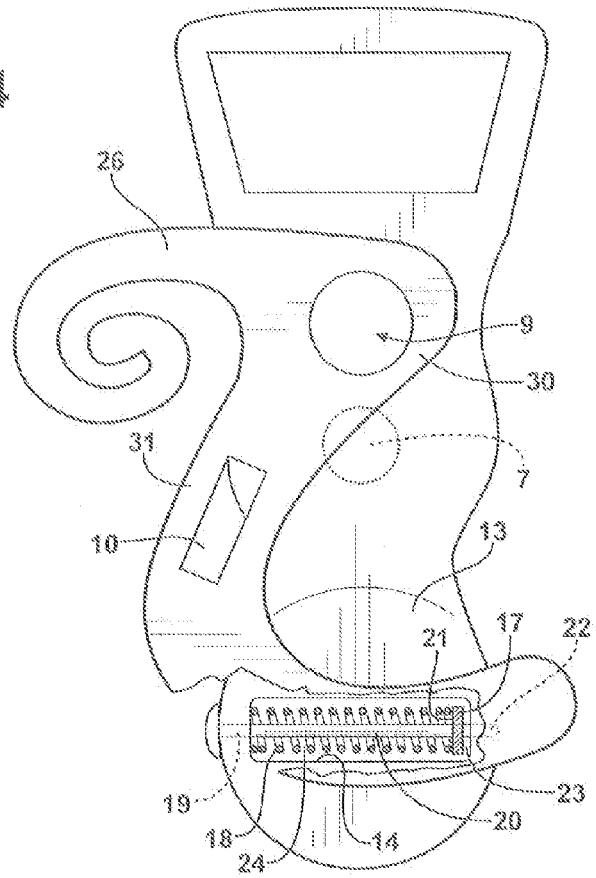
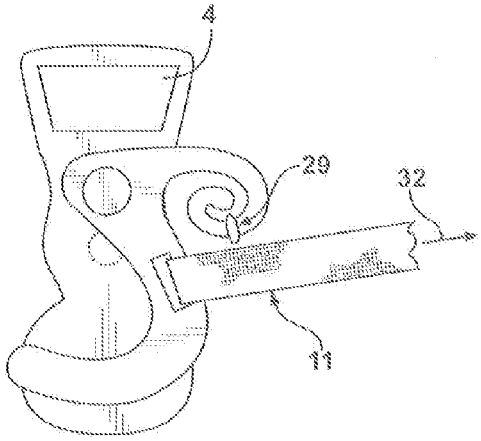
FIG. 5A
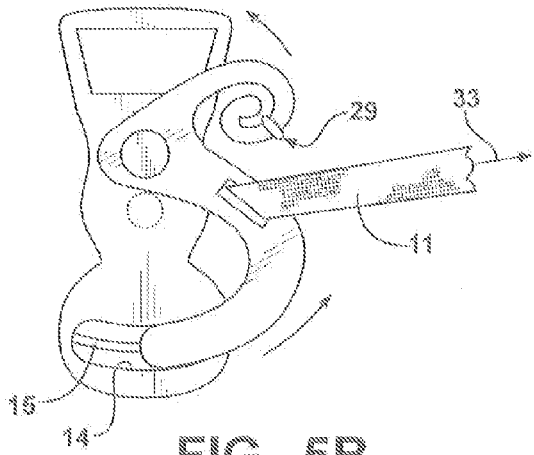
FIG. 5B

HORSE BITS

RELATED APPLICATION

This application claims priority to U.K. Patent Application No. 0525195.4 dated Dec. 12, 2005 and U.K. Patent Application No. 0508733.3 dated Apr. 29, 2005.

FIELD OF THE INVENTION

The present invention relates to horse bits, and more particularly to horse-friendly horse bits.

BACKGROUND OF THE INVENTION

Over the years, a wide variety of bits has been used to control horses, for riding and driving. Whilst a great variety of different mouth pieces have been tried in the past, in order to provide greater comfort to the horse, a significant disadvantage of all such bits has been the stress and possible injury which may inadvertently be applied to the horse's mouth, in the hands of an inexperienced rider or driver and/or as a result of the horse being startled and shying or snatching, or the rider/driver jerking the reins.

It is an object of the present invention to avoid or minimize one or more of the abovementioned disadvantages.

SUMMARY OF THE INVENTION

The present invention provides a horse bit comprising a pair of side cheeks, each having a cheek strap coupling portion and a first cheek portion mounting a respective end portion of a mouth-piece, and a second cheek portion pivotally connected to said first cheek portion remote from said mouth-piece, and having a rein coupling portion remote from its pivotal connection to said first cheek, and wherein is provided a resilient biasing means formed and arranged for acting between said first and second cheek portions so as to resist displacement of said second cheek portion relative to said first cheek portion, in use of said bit, when a user pulls on the reins, whereby transmission of force through the reins to said mouth-piece is modulated.

With a horse bit of the present invention, the improved comfort afforded to the horse during rein control and protection against sudden shock to the mouth, has been found to provide a surprisingly large improvement in the performance of the horse under rein control, including one or more of: better head carriage, freer movement, better engagement in the quarters, easier maintenance on the bit, and lighter contact required. Various benefits of the present invention may moreover be achieved to a greater or lesser extent, with a wide range of different styles of horse bit and mouthpiece, as well as by both novices who can learn correct rein handling with less stress to the horse and experts who can achieve enhanced and even more refined control. Thus on the one hand the present invention may be embodied in a snaffle type bit with the general appearance and form of a conventional basic snaffle (see for example FIG. 10). On the other hand it may be embodied in a wide range of other bits (including riding and driving bits) of various general styles, including pelham bits, snaffle bits, curb bits, western style bits, etc. In this connection it may also be noted that the present invention may be used with both fixed cheek and swivel cheek, mounting of the mouth-piece on the first cheek portion—as further described hereinbelow with reference to the various embodiments illustrated in the accompanying drawings. Furthermore, the present invention may be used with more or less any of the wide range of mouthpieces in use with horse bits, including inter alia, generally straight, arcuate, cranked, jointed mouthpieces, which may moreover be provided with additional components such as rollers, etc.

With the second cheek portion pivotally connected to said first cheek portion remote from said mouth-piece, and the rein coupling portion remote from its pivotal connection to said first cheek portion, pressure through the reins results in pivotal displacement of the second cheek portion relative to said first cheek portion against a return force exerted by said resilient biasing means. When such a bit has a curb chain attached to said second cheek portion, this has the further advantage of providing a dual action effect with only a single pair of reins.

In a preferred form of the invention suitable for use as a double action bit, the second cheek portion is generally 'Z' (including so-called 'lazy-Z' and 'S'—when viewed from the opposite side) form with the resilient biasing means formed and arranged for acting between a lower limb portion and the first cheek portion, the upper limb portion having at its distal end a curb chain mounting portion, and the pivotal connection to the first cheek portion being disposed generally in the region joining the upper limb portion to the central limb portion.

With such a double action bit, a light contact on the reins will cause the bit to operate similar to a "snaffle" or a "Liverpool" driving bit with pressure felt mainly on the mouth. The bit will rotate slightly around the mouthpiece bringing the curb chain into contact with the chin but with very little pressure. The pony/horse will move forward freely and with the correct head carriage. When pressure on the reins is increased causing the second cheek portion to pivot around its connection to the first cheek portion, this places a firmer pressure on the chin and the pony/horse slows down or changes pace. Reducing pressure on the reins causes the second cheek to return under spring pressure releasing pressure on the chin. This stage of operation is much like the action of a purely curb bit e.g. a "Liverpool" bit with the reins on any of the slots below the mouthpiece.

Furthermore by altering the offset between the rein attachment portion on the second cheek portion relative to its pivotal connection to the first cheek portion, it is possible to modify the relative effects of the mouth-piece and curb chain, so as to bias the bit action towards a greater mouth effect or a greater chin effect. It will also be understood that the overall size of the bit will generally depend on the size of the horse on which it is intended to be used, with the relative dimensions of the various parts thereof, being scaled up or down, correspondingly. Typically a horse size bit is around 1.25 times larger than a cob size bit, which in turn is around 1.25 times larger than a pony size bit. In the case of a Curb type bit the shank length (corresponding to the overall length of the side cheeks) would generally be around 95 mm for pony size, 115 mm for cob size, and 125 mm for horse size, whilst in a Snaffle type bit, the respective overall heights of the side cheeks would generally be 90 mm, 105 mm, and 110 mm. In a pony size bit, the pivot point will generally be about 15 mm (+/−20%) above the mouthpiece, whilst the rein slot (or upper or highest rein slot, when there is more than one) will be not more than about 10 mm (+/−20%) below the mouthpiece, corresponding to not more than about 25 mm below the pivot point. The corresponding offsets for cob and horse would generally be pro rata, so that more generally, the pivot point offset would be about 15 to 20 mm (+/−20%) above and the rein slot offset would be about 10 to 13 mm (+/−20%) below. The curb chain mounting will generally be disposed a similar distance from the pivot point—albeit in a generally horizontal direction. With a larger offset of the rein coupling portion below the mouthpiece (relative to the pivotal connection offset above the mouthpiece), there may be obtained a more severe curb action.

It will be appreciated that the bits of the present invention may be made of any material conventionally used in horse bits, such as stainless steel, conveniently 314 or 316 grade stainless steel, with a wide variety of materials being usable on or in the mouthpiece in particular, including rubber, and plastics.

Various forms of resilient biasing means may be used in the bits of the present invention. Conveniently there may be used mechanical springs such as helical compression springs which can be readily enclosed in a piston and cylinder mounting so as to avoid interference between the spring and the horse, and minimize the risk of damage to the spring. Various other forms of mechanical spring may also be used such as coil springs, torsion springs, etc, with suitable mounting arrangements so as to provide the required resilient biasing action between the first and second cheek portions, with the springs (or other resilient biasing means) substantially enclosed within either or both of the cheek portions, so as to minimize the risk of interference with and possible injury, to the horse. Suitable spring grade steels would generally be used for such mechanical resilient biasing means, but other materials such as suitable engineering plastics, could also be employed. Alternatively there may be used resiliently deformable natural or synthetic polymers (including copolymers etc), such as natural or synthetic rubbers, which may be solid or semi-solid (e.g. a high viscosity high elasticity gel). These may be in the form of solid bodies (such as a generally cylindrical body) of such material, or more complex shapes such as for example a tube-form. A wide variety of such materials is available including suitable grades of inter alia: polyurethane, polyethylene, polyvinyl chloride, propylene, polyamide, neoprene, nitrile, vinyl, nylon, polyester, butadiene acrylonitriles and etyrene rubbers, latex, with silicone rubber or elastomer, and silicone gel, being particularly convenient. In general the material should have a relatively low Shore hardness, preferably not more than 80, desirably from 35 to 75, advantageously from 40 to 60, and a low compression set, preferably not more than 5% at ambient temperature. Suitable silicone rubber tubing is readily available commercially, for example, from Viking Extrusions Limited of Worthing, England under the Product Names VGP40 and VGP60. Conveniently there may be used tubing having an I(Internal Diameter) of from 2 to 5 mm, and a wall thickness of from 1 to 4 mm, preferably tubing having an ID of 3 mm and OD (Outside Diameter) of about 7 mm.

Whilst steel compression springs generally offer more design flexibility than polymer material biasing elements, they may be more susceptible to corrosion and possible damage from ingress of foreign material.

In order to improve reliability of operation of the resilient biasing means, this is most conveniently in the form of a generally tubular spring (helical spring or tube of polymeric material) disposed about an elongate guide pin.

It will be appreciated that the modulating effect of the resilient biasing means will depend on the spring force required to obtain maximum pivotal displacement of the second cheek portion relative to the first cheek portion. This may be varied within relatively wide limits depending on inter alia user preference and/or the characteristics of the individual horse. In general though the resilient biasing means would conveniently have a spring force corresponding to a rein pull load of from 2 to 6 kg, preferably from 2.5 to 5 kg, for obtaining maximum pivotal displacement of the second cheek portion relative to the first cheek portion.

BRIEF DESCRIPTION OF THE DRAWINGS

Further preferred features and advantages of the present invention will appear from the following detailed description given by way of example of some preferred embodiments described with reference to the accompanying drawings in which:

FIG. 4 is a partially cut-away detail view of the right side elevation of the bit of FIG. 1;

FIGS. 5A and B are side elevations corresponding to FIG. 3 illustrating operation of the bit;

DETAILED DESCRIPTION OF ILLUSTRATIVE EMBODIMENTS

Figure 1:
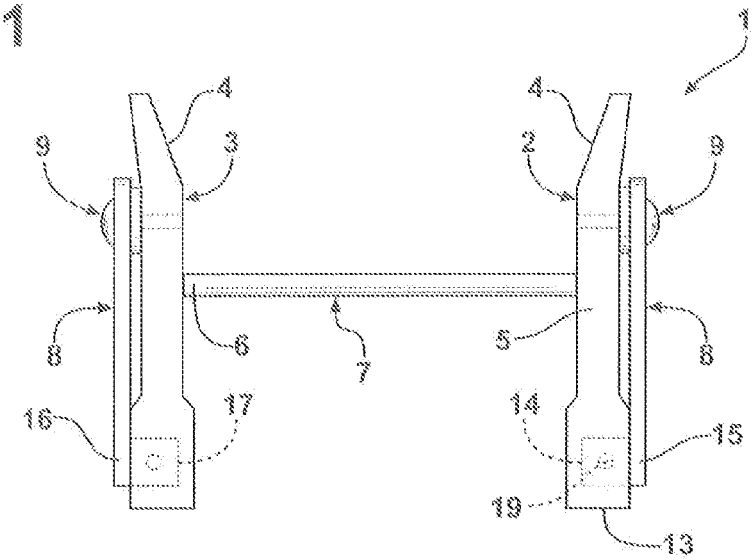
FIG. 1 is a schematic front elevation of a first embodiment of a horse bit of the invention.
Figure 2:
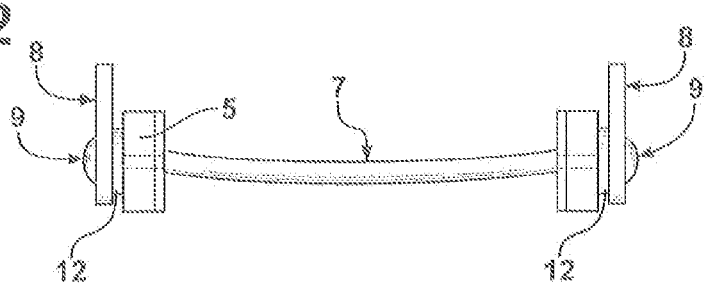
FIG. 2 is a plan view of the bit of FIG. 1.

FIG. 1 shows a horse bit 1 comprising a pair of left and right side cheeks 2,3, each having a cheek strap coupling portion 4. Each cheek 2,3 also has a first cheek portion 5 mounting opposite ends 6 of a mouth-piece 7. A second cheek portion 8 is pivotally connected 9 to the first cheek portion 5 so as to be displaceable between a first position and a second position relative thereto (see FIGS. 5A and B further described hereinbelow), and has a rein coupling portion 10 for connecting a rein 11 (see FIGS. 5A and B) to it. A bush 12 is provided on the pivot pin 9 between the first and second cheek portions 5,8 to ensure free pivotal movement between the cheek portions.

The base 13 of the first cheek portion 5 is provided with an elongate guide slot 14 having its open face 15 opposite the respective second cheek portion 8. The lower end 16 of the second cheek portion 8 has a tab portion 17 which projects into the slot 14 so as to be slidable along said slot 14 during pivotal movement of the second cheek portion 8. As may be seen in FIG. 4, a guide pin 18 has a screw threaded head portion 19 for securing it to the base portion 13 of the second cheek portion 8, so that the shank 20 of the guide pin 18 extends longitudinally of the guide slot 14, through an aperture 21 in the second cheek portion tab 15, engaging in a recess 22 in the base portion 13 at the far end 23 of the guide slot 14. A resilient biasing means in the form of a helical spring 24 is disposed around the shank 20 of the guide pin 18 for acting between the tab 17 and the second cheek portion base 13 at the guide pin head portion 19, so as to resist displacement of the second cheek portion 8 relative to the first cheek portion 5, when a user pulls on the reins 11, whereby transmission of force through the reins 11 to the mouth-piece 7 is softened.

Figure 3:
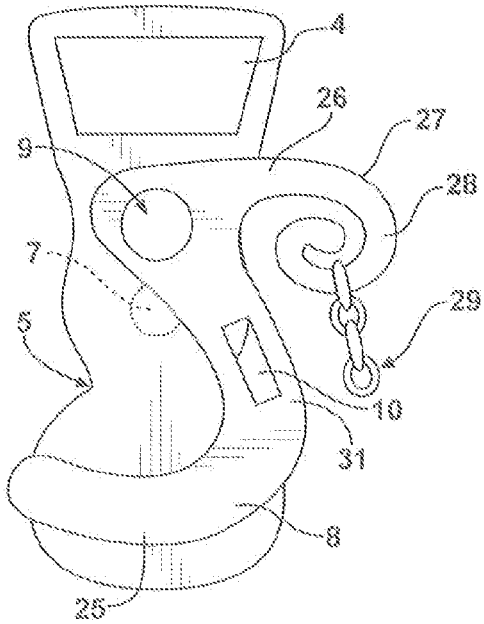
FIG. 3 is a left side elevation of the bit of FIG. 1.

As may be seen in FIGS. 3 to 5, the second cheek portion 8 is generally 'Z' form with the resilient biasing means 24 acting between a lower limb portion 25 of the second cheek portion 8 and the first cheek portion 5, an upper limb portion 26 having at its distal end 27, a mounting portion 28 for a curb chain 29, and the pivotal connection 9 to the first cheek portion 5 being disposed generally in the region 30 joining the upper limb portion 26 to the central limb portion 31.

In use of such an arrangement, light pressure 32 on the reins 11 results only in a light pressure on the horse's mouth via the mouth-piece 7 (see FIG. 5A). A stronger pressure 33 on the reins 11 (see FIG. 5B) results in a limited increase in pressure on the horse's mouth, as well as a drawing up and into the horse's chin, of the curb chain 29, thereby providing a dual action on the horse's head.

Figure 6:
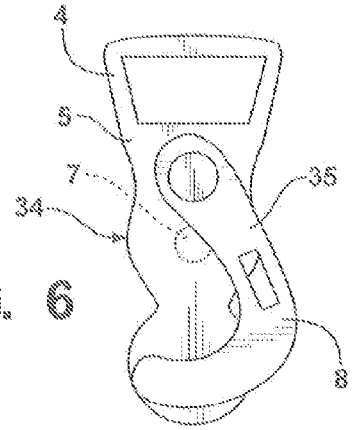
FIGS. 6 to 10 are schematic side elevations of some alternative embodiments of the invention.

FIG. 6 shows a simplified form of bit 34 according to the present invention, in which there is used a generally 'J' or 'L' form second cheek portion 35 without a curb chain.

Figure 7:
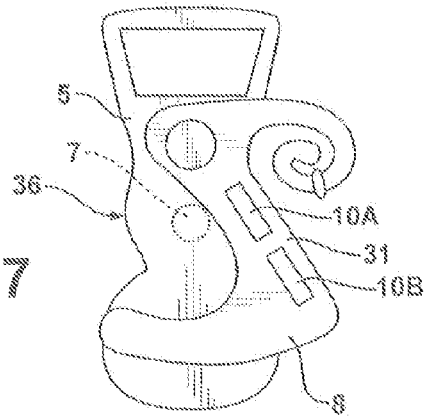

FIG. 7 shows a modified form 36 of the bit of FIGS. 1 to 5, in which the central limb portion 31 of the second cheek portion 8, has alternative, upper and lower, rein attachment slots 10A, 10B, whereby the relative bias between the mouth and chin actions of the bit, can be changed by using one or other of the slots.

Figure 8:
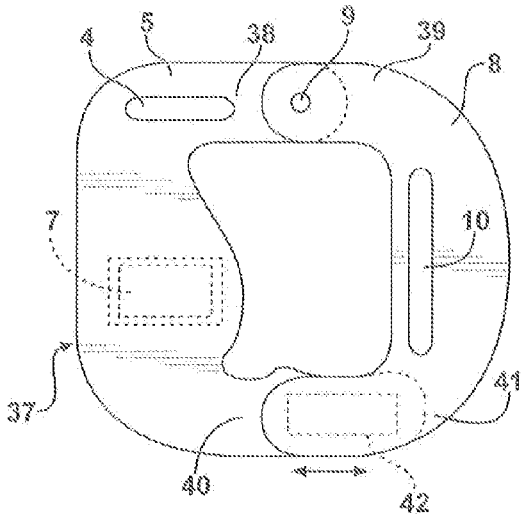

FIG. 8 shows a snaffle style form of bit 37, with generally 'C' or 'U' form first and second cheek portions 5,8, pivotally connected 9 to each other at their upper ends 38,39, and coupled to each other at their lower ends 40,41, via a resilient biasing linkage 42 such as that illustrated in FIGS. 1 to 4 (as well as FIG. 10 below).

Figure 9:
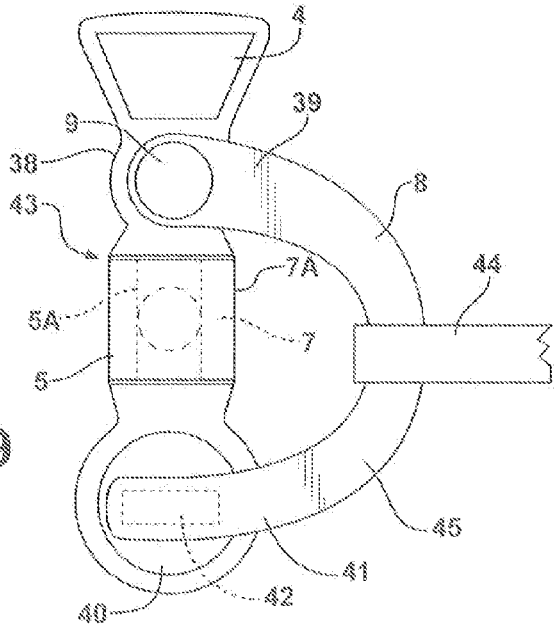

FIG. 9 shows a Baucher snaffle style bit 43, in which the first cheek portion 5 is generally similar to that of the previously described embodiments of FIGS. 1 to 7, and a second cheek portion 8 is generally 'C'- or 'U'-shaped. As before, the upper ends 38,39 of the cheek portions 5,8 are pivotally connected together 9. In this case, the bit 43 is not provided with a discrete rein coupling slot (such as the slot 10 in the FIG. 8 embodiment), and the reins 44 are instead secured around the main body 45 of the second cheek portion 8 in similar fashion to that with a conventional snaffle.

Figure 10:
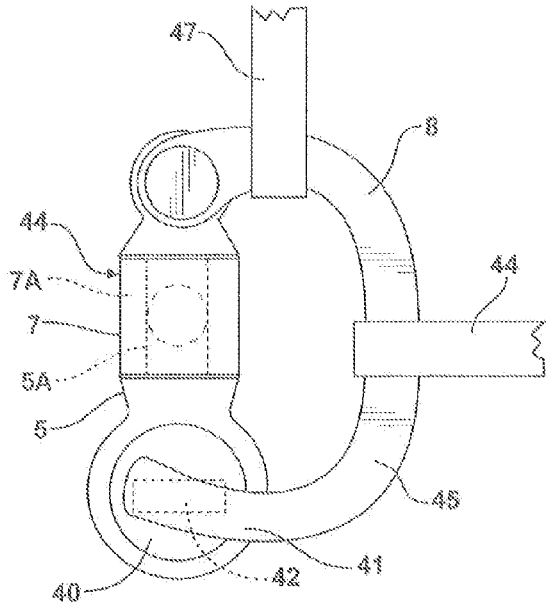

FIG. 10 shows a more conventional basic snaffle style bit 46, in which the first cheek portion 5 is generally similar to that of FIG. 9, but without the upwardly projecting cheek strap coupling portion 4, the cheek strap 47 instead being secured around the main body 45 of the second cheek portion 8 in similar fashion to that with a conventional snaffle.

In both the embodiments of FIGS. 9 and 10, the first and second cheek portions 5,8 are coupled to each other at their lower ends 40,41, via a resilient biasing linkage 42 such as that illustrated in FIGS. 1 to 4 (as well as FIG. 10 or 11 below). Also, in both cases the mouth-piece 7, instead of having a fixed cheek mounting on the first cheek portion 5 i.e. with the end of the mouth-piece rigidly secured to the first cheek portion, as in the case of the bits of FIGS. 1 to 8, has a swivel cheek mounting of the kind generally used on snaffle bits. In more detail, the ends 7A of the mouth-piece are generally tubular or ring form and mounted on a neck portion 5A of the first cheek portion 5, so that they can swivel about the neck portion 5A. In this case, the mouth-piece would generally be a jointed mouth-piece (not shown) i.e. comprising two (or more) sections with a swivel link inter-connection.

It will be appreciated that various modifications may be made to the above described embodiments without departing from the scope of the present invention. Thus for example, in the case of pivotally linked cheek portions, there could be used other forms of resilient biasing means, such as torsion springs of one form or another formed and arranged for acting around the rotational axis of the pivotal connection 9. Furthermore, higher or lower tension resilient biasing means may be used as required to suit the needs of different horses and/or different riders/drivers.

Figure 11:
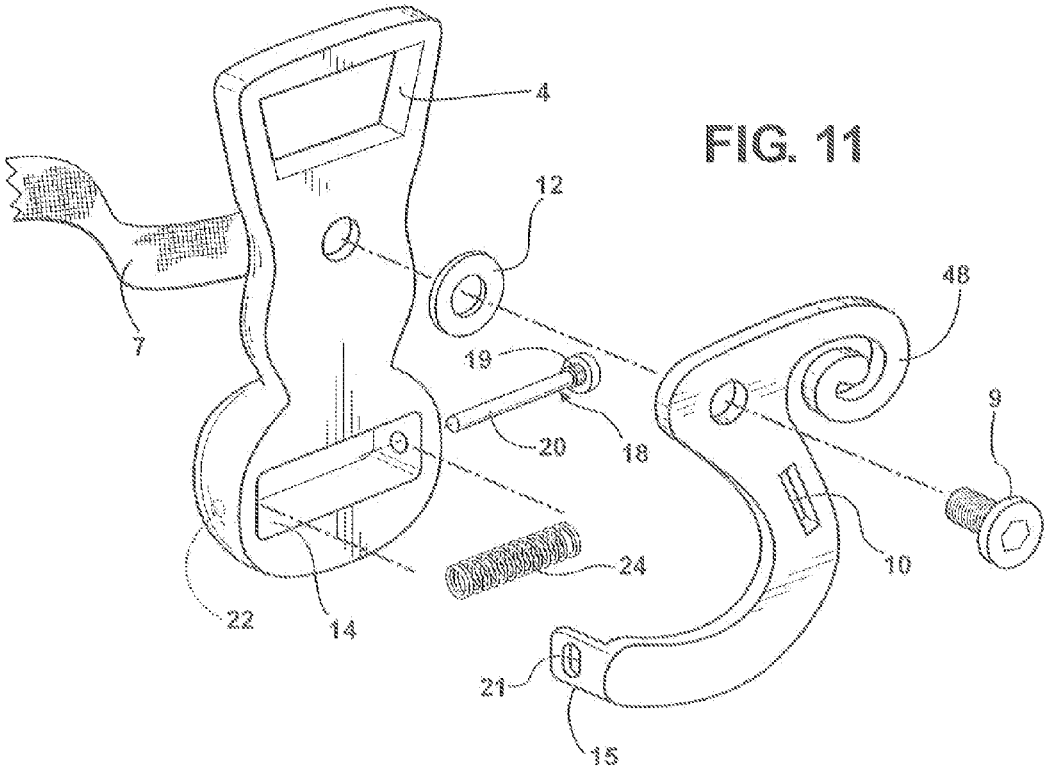
FIG. 11 is a partial exploded perspective view of another embodiment similar to that of FIGS. 1 to 5.

FIG. 11 shows a partly exploded perspective view of another embodiment similar to that of FIGS. 1 to 5, in which there is used an alternative form of mounting portion 48 for supporting the curb chain 29 (not shown in this Figure).

Figure 12:
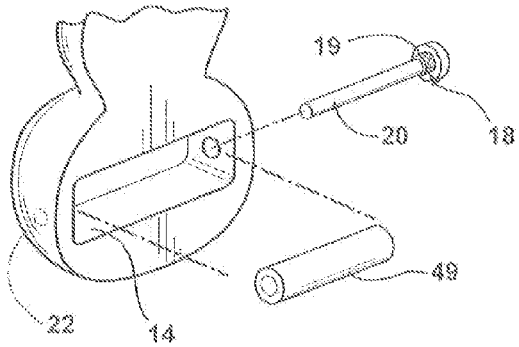
FIG. 12 is a detail view illustrating use of a silicone rubber tube biasing means.

FIG. 12 is a detail view illustrating use of a silicone rubber tube 49 as the resilient biasing means in place of the spring 24 shown in FIG. 11.

Figure 13:
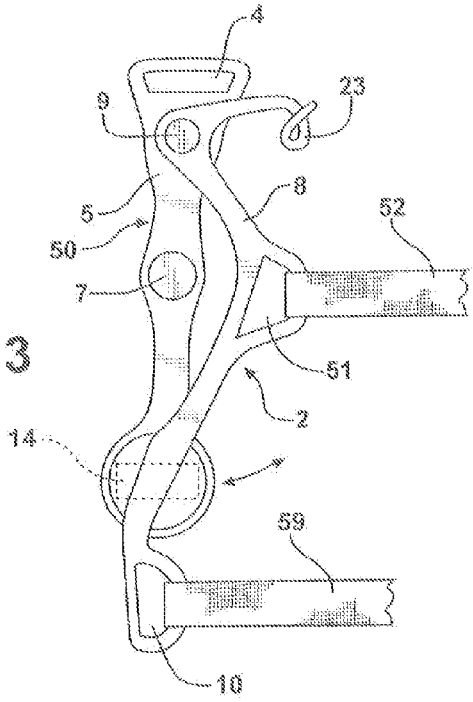
FIGS. 13 and 14 are schematic side elevations of some yet further embodiments of the invention.

FIG. 13 is a side elevation of a Pelham type bit 50 which is used with two sets of reins. In this case the second cheek portion 8 is relatively elongated, with an upper rein coupling portion 51 for connection of the bradoon rein 52 at around the level of the mouth-piece 7, and a lower rein coupling portion 53 for connection of the curb rein 54 below the level of the biasing means 14-24 which is substantially similar to that of FIGS. 4 and 11.

Figure 14:
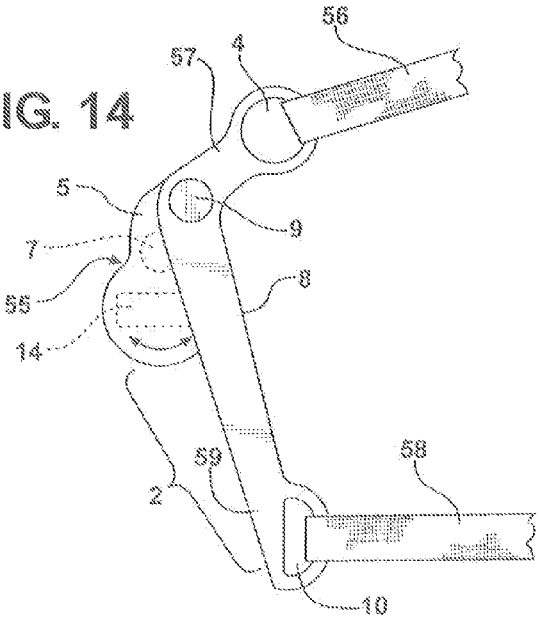
Figure 15:
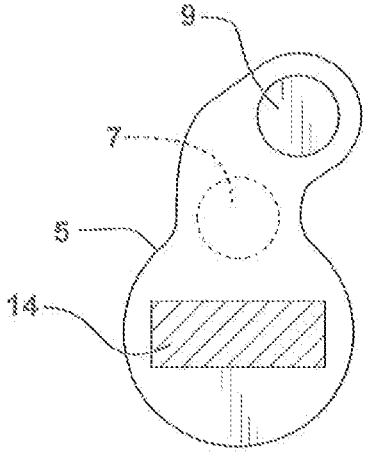
FIG. 15 is a detail side elevation of the first cheek portion of the bit of FIG. 14.
Figure 16:
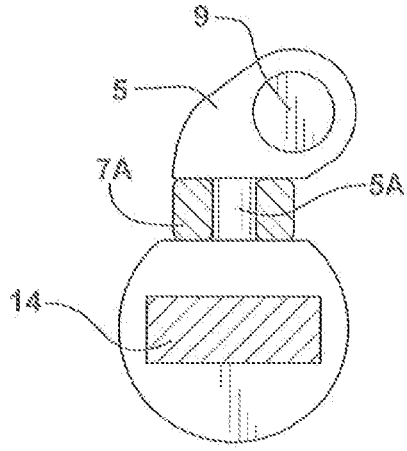
FIG. 16 is a detail side elevation of a modified form of the first cheek portion of the bit of FIG. 14.

FIG. 14 is a side elevation of a Western or Gag type bit 55 which also has a second cheek portion 8 which is relatively elongated. In this case the first cheek portion 8 is relatively compact, and the cheek strap coupling portion 4, via which the bit 55 is connected to the cheek strap 56 of the bridle (only partly shown), is provided on the second cheek portion 8 of the side cheek 2, at the upper end 57 thereof. In this case, the rein coupling portion 10, via which the rein 58 (only part shown), is coupled to the bit 55, is provided at the lower end 59 of the second cheek portion well below the level of the biasing means 14-24 which again is substantially similar to that of FIGS. 4 and 11. FIG. 15 shows the first cheek portion 5 only of the bit of FIG. 14, for greater clarity. FIG. 16 is a similar view to that of FIG. 15, albeit partly sectioned, of a modified form of the first cheek portion 5 with a neck portion 5A around which is disposed the respective generally tubular or ring form end 7A of the mouth-piece, so that it can swivel about the neck portion 5A, in generally similar manner to that shown in FIGS. 9 and 10.

Figure 17:
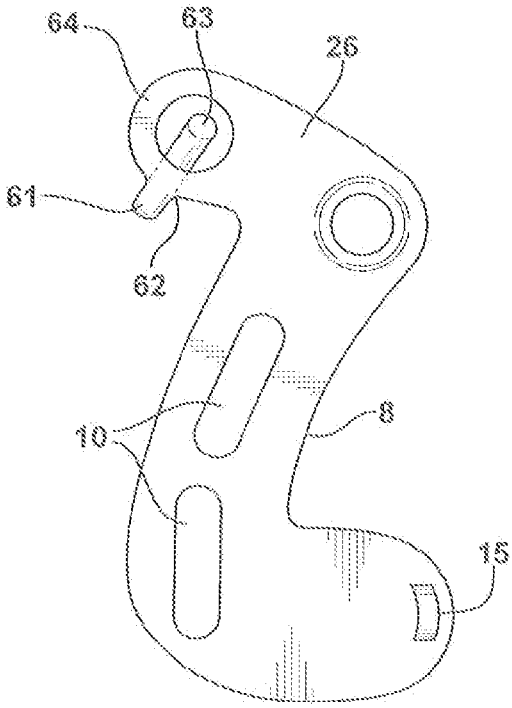
FIGS. 17 and 18 are respectively, a side elevation and a rear elevation, of a yet further modified form of second cheek portion.
Figure 18:
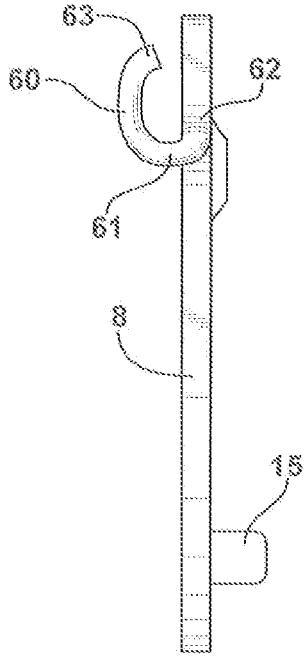

FIGS. 17 and 18 show a side elevation and a rear elevation, of a yet further modified form of second cheek portion 8, provided with a modified form of curb chain coupling of a fixed flat circle hook type. In more detail this comprises a generally 'C'-form lug 60, having a first end 61 fixed to an edge 62 of the upper limb portion 26 of the second cheek portion 8, and its other end 63 projecting into an opening 64 provided in said upper limb portion 26. This has the advantage of providing an easy to use and secure form of coupling.

What is claimed is:

1. A horse bit comprising a pair of side cheeks, each having a cheek strap coupling portion and a first cheek portion mounting a respective end portion of a mouth-piece, and a second cheek portion pivotally connected to said first cheek portion so as to be pivotally displaceable relative thereto about pivotal axis remote from said mouth-piece so as to be offset from the longitudinal axis of the mouthpiece, and independent of said mouthpiece, and having a rein coupling portion remote from its pivotal connection to said first cheek, and wherein is provided a resilient biasing means formed and arranged for acting between said first and second cheek portions remote from said pivotal axis, so as to resist pivotal displacement of said second cheek portion relative to said first cheek portion, in use of said bit, when a user pulls on the reins, whereby transmission of force through the reins to said mouth-piece is modulated, wherein the second cheek portion is generally 'Z' form with the resilient biasing means formed and arranged for acting between a lower limb portion and the first cheek portion, an upper limb portion having, at its distal end, a curb chain mounting portion, and the pivotal connection to the first cheek portion being disposed generally in a region joining the upper limb portion central limb portion.

2. A horse bit comprising a pair of side cheeks, each having a cheek strap coupling portion and a first cheek portion mounting a respective end portion of a mouth-piece, and a second cheek portion pivotally connected to said first cheek portion with a pivotal axis remote from said mouth-piece so as to be offset from the longitudinal axis of the mouthpiece, and having a rein coupling portion remote from its pivotal connection to said first cheek, and wherein is provided a resilient biasing means formed and arranged for acting between said first and second cheek portions so as to resist displacement of said second cheek portion relative to said first cheek portion, in use of said bit, when a user pulls on the reins, whereby transmission of force through the reins to said mouth-piece is modulated, said second cheek portion being generally 'Z' form with: a lower limb portion; an upper limb portion having, at its distal end, a curb chain mounting portion; a central limb portion; and a region joining the upper limb portion to said central limb portion, said resilient biasing means formed and arranged for acting between said lower limb portion and said first cheek portion, and said pivotal connection to said first cheek portion being disposed generally in said region joining the upper limb portion to said central limb portion.

* * * * *